US006374064B1

(12) United States Patent
Budnik et al.

(10) Patent No.: US 6,374,064 B1
(45) Date of Patent: Apr. 16, 2002

(54) XEROGRAPHIC DEVELOPMENT SYSTEM, METHOD FOR DETERMINING WHEN THE DEVELOPER MATERIAL SUPPLY SHOULD BE REPLENISHED

(75) Inventors: Roger W. Budnik, Rochester; James M. Pacer, Webster; Scott L. Kauffman; Richard M. Maier, both of Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/669,198

(22) Filed: Sep. 25, 2000

(51) Int. Cl.[7] ..... G03G 15/08

(52) U.S. Cl. ..... 399/27; 399/29; 399/30; 399/49

(58) Field of Search ..... 399/27, 29, 30, 399/49, 58, 60, 61, 62

(56) References Cited

U.S. PATENT DOCUMENTS 4,614,165 A * 9/1986 Folkins et al. ..... 118/657
5,204,698 A * 4/1993 LeSueur et al. ..... 347/140
5,390,004 A * 2/1995 Hopkins ..... 399/42
5,402,214 A * 3/1995 Henderson ..... 399/58
5,895,141 A * 4/1999 Budnik et al. ..... 399/58
6,035,152 A * 3/2000 Craig et al. ..... 399/49

* cited by examiner

*Primary Examiner*—Sophia S. Chen
*Assistant Examiner*—Hoan Tran
(74) *Attorney, Agent, or Firm*—R. Hutter

(57) ABSTRACT

In a xerographic development system, a primary developer supply is used to develop electrostatic latent images. A secondary developer supply is available to dispense new developer, as needed, into the primary developer supply. A series of inputs, including counting the number of printed pixels and monitoring the reflectivity of a set of test patches, is entered into an algorithm which controls the dispensing of new developer. The various inputs are converted into metrics which relate to an amount of time fresh developer is dispensed into the primary developer supply.

11 Claims, 2 Drawing Sheets

XEROGRAPHIC DEVELOPMENT SYSTEM, METHOD FOR DETERMINING WHEN THE DEVELOPER MATERIAL SUPPLY SHOULD BE REPLENISHED

FIELD OF THE INVENTION

The present invention relates to a system for controlling the concentration of toner within the developer mixture in a xerographic printer.

BACKGROUND OF THE INVENTION

In the well-known process of electrostatographic printing, also known as "xerography," a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finally divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate, such as paper, and the image affixed thereto to form a permanent record of the image to be reproduced.

The step in the electrophotographic process in which the toner is applied to the latent image is known as "development." In any development system, a quantity of toner is brought generally into contact, with the latent image, so that the toner particles will adhere or not adhere to various areas on the surface in conformity with the latent image. Many techniques for carrying out this development are known in the art. A number of such techniques require that the toner particles be evenly mixed with a quantity of "carrier." Generally speaking, toner plus carrier equals "developer." Typically, toner particles are extremely fine, and responsive to electric fields; carrier particles are relatively large and respond to magnetic fields. In a "magnetic brush" development system, the developer is exposed to relatively strong magnetic fields, causing the carrier particles to form brush-like strands, much in the manner of iron filings when exposed to a magnetic field. The toner particles, in turn, are triboelectrically adhered to the carrier particles in the strands. What is thus formed is a brush of magnetic particles with toner particles adhering to the strands of the brush. This brush can be brought in contact with the latent image, and under certain conditions the toner particles will separate from the carrier particles and adhere as necessary to the photoreceptor.

An important process parameter for any development system is the ratio of toner particles to carrier within the developer. It is also expectable that, in the course of use of the printer, the toner to carrier ratio (T/C) will change significantly as toner particles are transferred from the developer supply to the photoreceptor and ultimately to print sheets. There have thus been numerous systems devised in the prior art for determining and controlling this T/C in an operating machine. Because carrier particles are generally heavy and magnetic, while toner particles are generally light and non-magnetic, many of these systems involve detecting the behavior of magnetic flux through the developer; placing a quantity of developer between capacitor plates and examining the electrical behavior thereof; or electrically drawing a quantity of toner from the developer and inferring a T/C therefrom. However, very often such systems have proven to be either inaccurate, imprecise, or too expensive for use in inexpensive printers and copiers.

The present invention is directed to a highly precise system for monitoring and controlling the T/C in a developer supply.

DESCRIPTION OF THE PRIOR ART

U.S. Pat. No. 4,614,165 discloses the general concept of using a secondary developer supply for gradually admixing fresh developer into a primary developer supply, thereby retaining a reasonably constant T/C in the primary developer supply.

U.S. Pat. No. 5,204,698 discloses the concept of counting developed pixels in image data, and relating the pixel count to a determination of when toner should be dispensed into a primary developer supply.

U.S. Pat. No. 5,390,004 discloses a control system for a xerographic printing system in which the reflectivity of a set of test patches is measured, and the reflectivities are fed into a fuzzy-logic control system for the xerographic parameters.

U.S. Pat. No. 5,402,214 discloses a control system for a xerographic printing system in which the reflectivity of a test patch is measured, and the DC bias of a field associated with the development unit is adjusted accordingly. When the DC bias is caused to exceed a predetermined maximum, fresh developer is added to the primary developer supply.

U.S. Pat. No. 6,035,152 discloses a control system for a xerographic printing system in which the reflectivity of a set of test patches is measured, and the reflectivities are fed into a control system for the xerographic parameters.

SUMMARY OF THE INVENTION

According to one aspect of the present invention, there is provided an electrostatographic printing system in which there is provided a primary supply of developer material, the developer material comprising toner and carrier, wherein the developer material in the primary supply is used for developing electrostatic latent images on a charge receptor, a secondary supply of developer material, and dispense means for conveying developer material from the secondary supply to the primary supply. A control method comprises the steps of monitoring a dispense rate of toner being used to develop electrostatic latent images, thereby determining a pixel dispense in substantially real time; monitoring a ratio of toner to carrier (T/C) in the primary supply, thereby determining a T/C dispense in substantially real time; and developing a test patch with the developer material, the test patch being of a predetermined target reflectivity, and monitoring an actual reflectivity of the test patch, thereby determining a patch dispense in substantially real time. The dispense means is controlled according to an algorithm which takes into account the pixel dispense, the T/C dispense, and the patch dispense.

According to another aspect of the present invention, there is provided an electrostatographic printing system in which there is provided a primary supply of developer material, the developer material comprising toner and carrier, wherein the developer material in the primary supply is used for developing electrostatic latent images on a charge receptor, a secondary supply of developer material, and dispense means for conveying developer material from the secondary supply to the primary supply. At least one behavior of the system is monitored. In an algorithm, the monitored behavior is expressed as an amount of time for the dispense means to convey developer material. The dispense means conveys developer material from the secondary supply to the primary supply in response to accumulating a predetermined amount of time for the dispense means to convey developer material.

DETAILED DESCRIPTION OF THE INVENTION

Figure 1:
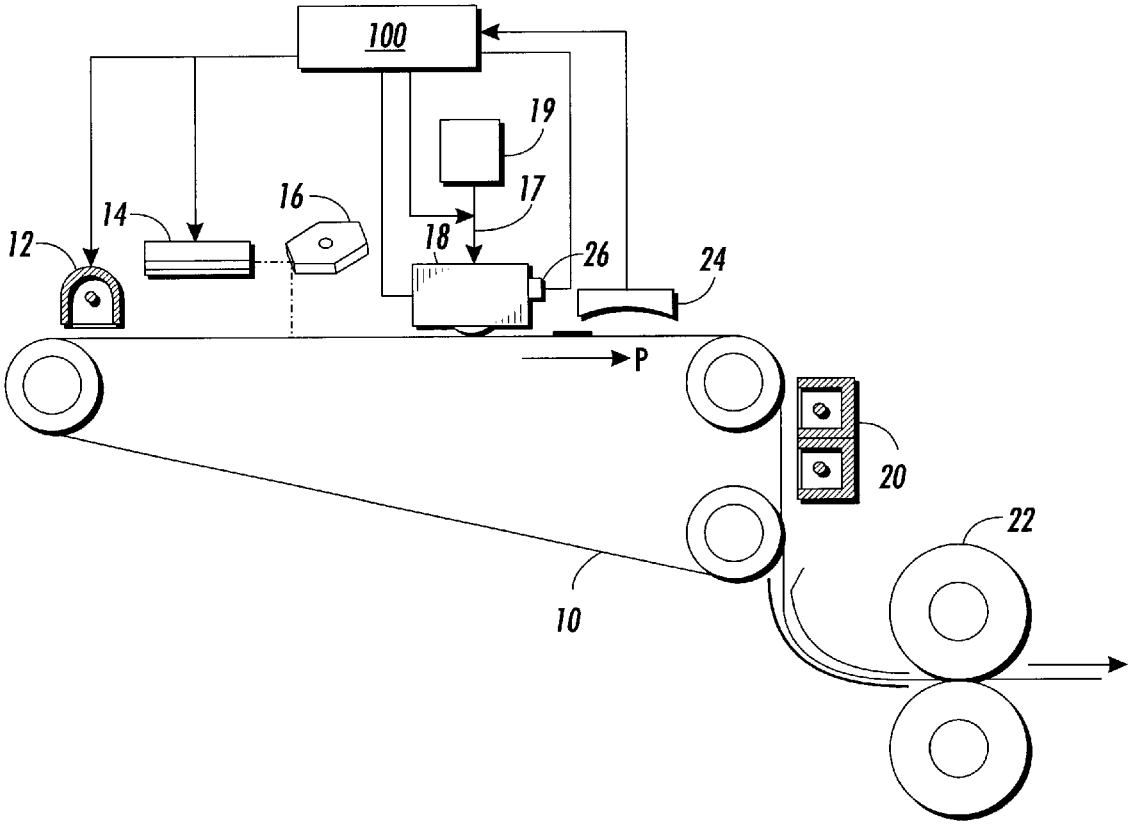
FIG. 1 is an elevational view showing the elements of a xerographic printer relevant to the present invention.

FIG. 1 shows the basic elements of the well-known system by which an electrophotographic printer, such as a copier or a "laser printer," creates a dry-toner image on plain paper. There is provided in the printer a photoreceptor 10, which may be in the form of a belt or drum, and which comprises a charge-retentive surface. The photoreceptor 10 is here entrained on a set of rollers and caused to move through process direction P. Moving from left to right in FIG. 1, there is illustrated the basic series of steps by which an electrostatic latent image according to a desired image to be printed is created on the photoreceptor 10, how this latent image is subsequently developed with dry toner, and how the developed image is transferred to a sheet of plain paper. The first step in the electrophotographic process is the general charging of the relevant photoreceptor surface. As seen at the far left of FIG. 1, this initial charging is performed by a charge source known as a "corotron," indicated as 12. The corotron 12 typically includes an ion-generating structure, such as a hot wire, to impart an electrostatic charge on the surface of the photoreceptor 10 moving past it. The charged portions of the photoreceptor 10 are then selectively discharged in a configuration corresponding to the desired image to be printed, by a raster output scanner or ROS, which generally comprises a laser source 14 and a rotatable mirror 16 which act together, in a manner known in the art, to discharge certain areas of the charged photoreceptor 10. Although the Figure shows a laser source to selectively discharge the charge-retentive surface, other apparatus that can be used for this purpose include an LED bar, or, in an analog copier, a light-lens system. The laser source 14 is modulated (turned on and off) in accordance with digital image data fed into it, and the rotating mirror 16 causes the modulated beam from laser source 14 to move in a fast-scan direction perpendicular to the process direction P of the photoreceptor 10.

After certain areas of the photoreceptor 10 are discharged by the laser source 14, the remaining charged areas are developed by a developer unit such as 18 causing a supply of dry toner to contact the surface of photoreceptor 10. The developed image is then advanced, by the motion of photoreceptor 10, to a transfer station including a transfer corotron such as 20, which causes the toner adhering to the photoreceptor 10 to be electrically transferred to a print sheet, which is typically a sheet of plain paper, to form the image thereon. The sheet of plain paper, with the toner image thereon, is then passed through a fuser 22, which causes the toner to melt, or fuse, into the sheet of paper to create the permanent image. Some of the system elements of the printer shown in FIG. 1 are controlled by a control system 100, the operation of which will be described in detail below.

Densitometer 24 is disposed along the path of photoreceptor 10 so as to detect the actual toner density of a test patch, which is intended to have a target density for an optimally-developed halftone on the photoreceptor. Systems for measuring the true optical density of a test patch are shown in, for example, U.S. Pat. No. 4,989,985 or U.S. Pat. No. 5,204,538. Densitometer 24, through means known in the art, should detect a density in a test patch which is consistent with this maximum practical density of toner on the photoreceptor 10.

Figure 2:
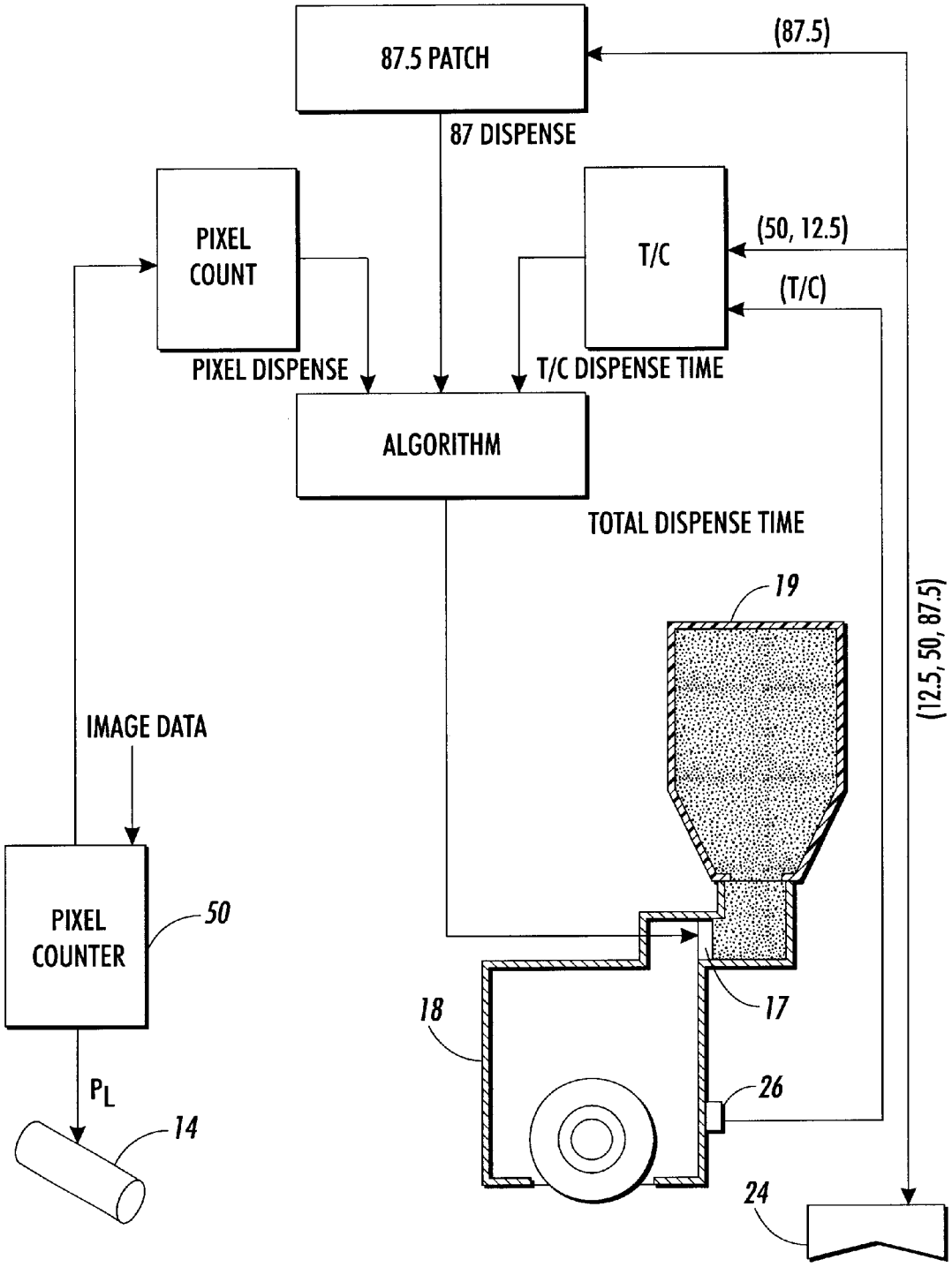
FIG. 2 is a diagram showing the operation of a control system according to the present invention.

FIG. 2 shows, in overview, the operation of the control system 100 according to the present invention. According to a preferred embodiment of the present invention, the main input to control system 100 is a set of ongoing test patch readings from densitometer 24. For purposes of the present invention, the most important output of the control system 100 is in the behavior of what is here generally called a "gate" 17. In terms of the claim language, the gate 17 acts as a selectably openable connection between the development unit 18, which can be considered in the "primary developer supply," and the hopper 19, which can be considered the "secondary developer supply." The primary developer supply is a the quantity of developer which is immediately usable for placing toner on photoreceptor 10; as such, it is expected it that quantities of toner will be constantly remove it from the primary developer supply, thus altering the T/C of the primary toner supply from its optimal level. When gate 17 is opened, fresh developer from hopper 19, which is the secondary developer supply, will replenish the primary developer supply, both refilling the developer unit 18 and (because the secondary developer supply is relatively rich in toner) bringing the T/C in developer unit 18 closer to an optimal level. (It is conceivable, according to a particular design, that the secondary developer supply could contain pure toner, with no carrier at all.)

The specific structure of gate 17 is not immediately germane to the invention, but as such can comprise any number of mechanical structures, such as a door, a valve, an auger, or any combination of such mechanical devices. As can be appreciated, the dispensing of developer from secondary supply 19 to primary supply 18 is difficult to control precisely. For example, gate 17, regardless of its specific structure, will typically have associated therewith a minimum opening time, meaning the shortest time between opening and closing thereof, which translates into a minimum amount of developer that must be dispensed to primary supply 18 whenever gate 17 is activated.

The present invention is directed to a control system which uses a series of inputs, in particular a series of test patch readings, for a control of gate 17 having a precision which is believed to be unprecedented in the prior art.

According to the preferred embodiment of the present invention, densitometer 24 reads test patches of three predetermined target halftone densities at various times over the course of operation of the printer. These halftone densities are a 12.5% halftone screen, a 50% halftone screen, and a 87.5% halftone screen. Deviations in the measured reflectivity (through densitometer 24) from the target reflectivities of the halftone screens are known to be useful measurements in controlling xerographic development. It is further known in the prior art that a deviation in the difference between the reflectivities of the 12.5% halftone screen and the 50% halftone screen is a somewhat reliable indicator, through a largely linear relationship, of the T/C in the primary developer supply. However, in practice, use of the combination of halftone screens has proven to be noisy as an input to a control system.

Further according to the preferred embodiment, the difference in measured reflectivities of the 12.5% and 50% halftone screens is used as a rough indication of the T/C, but, in addition, a reading of the actual reflectivity of the 87.5% halftone screen test patch is used as well. Further, a running count of number of printed pixels generated in the course of use of the machine is taken into account as an input of the algorithm of control system 100. These three distinct inputs, the T/C, the 87.5% test patch, and the pixel count, can be seen in the Figure as all contributing to the control system. Significantly, the combination of these three distinct inputs enable a precise operation of the present invention: it has been found that to use any one of these inputs exclusively results in poor control, because any one of these inputs is by itself noisy.

Another unique aspect of the present invention a is that the output of the control system 100 is expressed as a "total dispense time" associated with the gate 17. Other xerographic control systems known in the art, some of which can be used in conjunction with the present invention, can control relatively precisely controllable parameters, such as the biases on various elements associated with the xerographic process; in contrast, the present invention can be used to control what has heretofore been a relatively blunt means of controlling the xerographic process, namely of the dispensing of additional developer from a secondary supply to the primary developer supply.

The control system 100 operates as follows. The image data being used to print desired images is counted by a pixel counter 50; this pixel counter 50 may observe the behavior of the laser 14, or may derive data directly from the image data. This pixel count is then converted to a "pixel dispense," as will be explained below. The T/C which is monitored as a result of monitoring the actual measured reflectivity difference between the 12.5% and 50% halftone screen test patches is converted to a "T/C dispense." The actual reflectivity of the 87.5% halftone screen test patch is converted to an "87 dispense." These "dispenses" are numbers which express an amount of time that the gate 17 should be opened to admit new developer from secondary supply 19 to primary supply 18. A specific example is as follows:

Pixel Dispense:

pixel dispense=(image+patch) pixels*tonerGramsPerPixel/dispenseRate

TC Patch Dispense:

tc patch dispense=tcError*drrSlope/100*sumpMass/dispenseRate tc patch dispense=tc patch dispense/tc dispense interval 87 Patch Dispense:

87 patch dispense=87Error*87patchSlope/100*sumpMass/dispenseRate 87 patch dispense=87 patch dispense/87 dispense interval The various inputs to these algorithms are defined as follows:

(image+patch) pixels=a number of print-black (or color equivalent) pixels in a printed image, including, if necessary, pixels in an associated test patch dispenseRate=an empirically estimated rate at which developer is conveyed from the secondary supply to the primary supply tonerGramsPerPixel=gram weight of a developed pixel tcError=a difference, expressed in units of reflectivity from the reflectometer, between an actual reflectivity of a test patch and the target reflectivity. In the preferred embodiment, this reflectivity is not a single reflectometer reading, but rather is expressed as a difference in reflectomoeter readings between a 50% halftone test patch and a 12.5% halftone test patch, this difference being used as a rough indicator of T/C in the primary developer supply drrSlope=the empirically-determined slope of a linear relationship between T/C and a unit change in reflectivity of a test patch sump mass=gram weight of developer in primary developer supply tc dispense interval=interval, in number of printed images, tc dispense is divided over. For instance, in one embodiment of a xerographic printer, the 50% and 12.5% halftone test patches for monitoring T/C are generated after every 150 prints. Therefore, for normalization of the algorithm, this interval is set at 150.

87error=a difference, expressed in units of reflectivity from the reflectometer, between an actual reflectivity of the 87.5% test patch and the target reflectivity thereof. In the preferred embodiment, this reflectivity is another rough indicator of T/C in the primary developer supply 87patchSlope=the empirically-determined slope of a linear relationship between T/C and a unit change in reflectivity of the 87.5% test patch 87 dispense interval=interval, in number of printed images, 87 patch dispense is divided over. In the practical embodiment, the 87.5% test patches can be generated in interdocument zones after every eight prints, so this number is set at 8.

(Note: the use of the 87.5% test patch, as opposed to some other halftone screen value, for one type of determination of T/C is arbitrarily selected for one known practical embodiment. Generally, any fairly dense test patch, for instance from a 75% to a 100% screen, could conceivably be used in place of the 87.5% test patch, with the details of the control system being adapted accordingly.)

Significantly, it will be noticed that the units of the outputs of each algorithm above, Pixel Dispense, TC Patch Dispense, and 87 Patch Dispense, are time (in, typically, milliseconds) in which the gate 17 is opened to allow developer from secondary supply 19 to enter primary supply 18. The "total dispense" is the sum of these outputs:

=Pixel Dispense+TC Patch Dispense+87 Patch Dispense

It should be noted that, in a practical application of the system, certain of these addends may at various times be positive or negative.

A practical limitation of a xerographic printing system is that the gate 17 does not have fine control over the "dumping" of developer into primary supply 18: the gate 17, whether it is a door, a valve, an auger, or some other device, has associated therewith a minimum amount of time between opening and closing. In one practical embodiment, this minimum opening time is 750 milliseconds.

According to the invention, developer is conveyed from the secondary supply 19 through gate 17 to the primary supply, thus replenishing the primary developer supply 18 and re-establishing the optimal T/C therein, when the total toner dispense, expressed in milliseconds, exceeds the minimum opening time of the gate 17. Thus, in operation, the various toner dispenses will vary over time in response to readings of various test patches and other inputs. When the "total dispense" happens to exceed 750 milliseconds, the gate 17 can then be opened for the minimum practical time, 750 milliseconds, and this action will cause the various physical inputs (such as test patch readings) to once again approach their target values. If, for example in a heavy-toner-usage situation, the "total dispense" spikes up to a high number such as 1000 milliseconds, the gate 17 will then be opened by the system for 1000 milliseconds.

As mentioned above, in the preferred embodiment of the invention, the T/C dispense is derived from a rough estimate of the actual T/C based on a difference between actual reflectivities of a 12.5% halftone screen test patch and a 50% halftone screen test patch. However, in an alternate embodiment, this T/C can be derived from an output of a T/C sensor, typically in the form of a magnetometer, which is associated with the developer housing 18 in a manner generally familiar in the art. An example of such a magnetometer used in conjunction with the primary toner supply is shown as 26 in FIG. 2.

In overview, the present invention is directed toward a control system for xerographic development, in which the main output of the system is whether or not, and for how long, a gate between a primary developer supply and a secondary developer supply should be open. Although the basic concept of selectably opening and closing such a gate is known in the art, the particular practical success of the present invention largely relates to the fact that a combination of three different inputs are used in the algorithm which determines the behavior of the gate. By using a combination of three distinct inputs, namely the pixel count , the T/C, and the observed actual density of a relatively dark test patch, the bad effects created by statistical noise within each single input are largely obviated. Further, because of the output of such an algorithm is a period of time in which the gate is open, the gate can be controlled to admit new developer to the primary developer supply with a precision which is believed to have been impractical in the prior art.

What is claimed is:

1. In an electrostatographic printing system in which there is provided a primary supply of developer material, the developer material comprising toner and carrier, wherein the developer material in the primary supply is used for developing electrostatic latent images on a charge receptor, a secondary supply of developer material, and dispense means for conveying developer material from the secondary supply to the primary supply, a control method comprising the steps of:

monitoring a dispense rate of toner being used to develop electrostatic latent images, thereby determining a pixel dispense in substantially real time;

monitoring a ratio of toner to carrier (T/C) in the primary supply, thereby determining a TIC dispense in substantially real time;

developing a test patch with the developer material, the test patch being of a predetermined target reflectivity, and monitoring an actual reflectivity of the test patch, thereby determining a patch dispense in substantially real time; and controlling the dispense means according to an algorithm which takes into account the pixel dispense, the T/C dispense, and the patch dispense.

2. The method of claim 1, wherein each of the pixel dispense, T/C dispense, and patch dispense is expressed as an amount of time for the dispense means to convey developer material.

3. The method of claim 2, wherein the controlling step includes causing the dispense means to convey developer material from the secondary supply to the primary supply in response to the algorithm accumulating a predetermined amount of time for the dispense means to convey developer material.

4. The method of claim 1, wherein the step of monitoring a ratio of toner to carrier (T/C) in the primary supply includes monitoring a reflectivity of a test patch of at least a first predetermined target reflectivity on the charge receptor.

5. In an electrostatographic printing system in which there is provided a primary supply of developer material, the developer material comprising toner and carrier, wherein the developer material in the primary supply is used for developing electrostatic latent images on a charge receptor, a secondary supply of developer material, and dispense means for conveying developer material from the secondary supply to the primary supply, a control method comprising the steps of:

monitoring at least one behavior of the system;

in an algorithm, expressing the monitored behavior as an amount of time for the dispense means to convey developer material; and causing the dispense means to convey developer material from the secondary supply to the primary supply in response to accumulating a predetermined amount of time for the dispense means to convey developer material.

6. The method of claim 5, wherein the monitoring step includes monitoring a dispense rate of toner being used to develop electrostatic latent images.

7. The method of claim 5, wherein the monitoring step includes monitoring a ratio of toner to carrier (T/C) in the primary supply.

8. The method of claim 5, wherein the monitoring step includes developing a test patch with the developer material, the test patch being of a predetermined target reflectivity, and monitoring an actual reflectivity of the test patch.

9. The method of claim 5, wherein the monitoring step includes monitoring at least two of (a) a dispense rate of toner being used to develop electrostatic latent images, (b) a ratio of toner to carrier (T/C) in the primary supply, and (c) an actual reflectivity of a test patch of a predetermined target reflectivity.

10. The method of claim 5, wherein the predetermined amount of time for the dispense means to convey developer material relates to a minimum practical amount of time for the dispense means to convey developer material.

11. The method of claim 5, the causing step including causing the dispense means to convey developer material from the secondary supply to the primary supply for a period of time calculated with the algorithm.

* * * * *